US005217600A

United States Patent [19]

Le et al.

[11] Patent Number: 5,217,600

[45] Date of Patent: Jun. 8, 1993

[54] PROCESS FOR PRODUCING A HIGH EMITTANCE COATING AND RESULTING ARTICLE

[75] Inventors: Huong G. Le, Fountain Valley; Dudley L. O'Brien, Los Angeles, both of Calif.

[73] Assignee: McDonnell Douglas Corporation, Long Beach, Calif.

[21] Appl. No.: 876,768

[22] Filed: May 1, 1992

[51] Int. Cl.[5] ..... C25D 11/06

[52] U.S. Cl. ..... 205/328

[58] Field of Search ..... 205/328

[56] References Cited

U.S. PATENT DOCUMENTS 3,099,610 7/1963 Cybriwsky et al. .
3,920,413 11/1975 Lowery .
4,397,716 8/1983 Gilliland et al. .

*Primary Examiner*—T. Tufariello
*Attorney, Agent, or Firm*—Max Geldin

[57] ABSTRACT

Process for anodizing aluminum or its alloys to obtain a surface particularly having high infrared emittance by anodizing an aluminum or aluminum alloy substrate surface in an aqueous sulfuric acid solution at elevated temperature and by a step-wise current density procedure, followed by sealing the resulting anodized surface. In a preferred embodiment the aluminum or aluminum alloy substrate is first alkaline cleaned and then chemically brightened in an acid bath The resulting cleaned substrate is anodized in a 15% by weight sulfuric acid bath maintained at a temperature of 30° C. Anodizing is carried out by a step-wise current density procedure at 19 amperes per square ft. (ASF) for 20 minutes, 15 ASF for 20 minutes and 10 ASF for 20 minutes. After anodizing the sample is sealed by immersion in water at 200° F. and then air dried. The resulting coating has a high infrared emissivity of about 0.92 and a solar absorptivity of about 0.2, for a 5657 aluminum alloy, and a relatively thick anodic coating of about 1 mil.

17 Claims, No Drawings

PROCESS FOR PRODUCING A HIGH EMITTANCE COATING AND RESULTING ARTICLE

The invention described herein was made in the performance of work under NASA Contract No. NAS9-18200 and is subject to the provisions of Section 305 of the National Aeronautics and Space Act of 1958 (42 U.S.C. 2457).

BACKGROUND OF THE INVENTION

This invention relates to producing a high emittance coating on aluminum or its alloys, and is particularly concerned with a novel anodizing process for aluminum or its alloys to achieve a coating having high infrared emittance and also low solar absorptance, and the product so produced.

In space, there is no atmosphere to conduct heat to or from a spacecraft. Therefore, all heat gain or loss must be by radiation. Radiation is accomplished through the use of thermal control surfaces which can absorb solar radiation and emit radiation to space. These surfaces have a range of desirable values for solar absorptivity ($\alpha$) and infrared emissivity ($\epsilon$). For surfaces such as the radiators, it is important to absorb as little solar radiation as possible (low $\alpha$) while radiating as much heat as possible to space (high $\epsilon$).

The $\alpha$ and $\epsilon$ properties of the thermal control surfaces must be stable to maintain the temperatures of the spacecraft in the range required for effective operation. However, spacecraft which are in orbit near the earth (commonly called the low earth orbit or LEO) experience a hostile space environment consisting of atomic oxygen, ultraviolet radiation, charged particles, and contamination from other spacecraft components. These factors have been known to degrade the optical properties of spacecraft thermal control surfaces.

The development of a suitable long-life thermal control coating is therefore essential for the longevity and integrity of spacecraft structures. This coating must also be economical and easy to handle and apply to structures. Common radiator coatings include inorganic white paints, silver-coated Teflon films, and silver-coated quartz tiles and anodic coatings. Although organic coatings such as silicone and fluorocarbon base coatings, can provide the desired optical properties, they are attacked and erode in the LEO environment. The quartz tiles have been very labor intensive to install particularly for the complex geometry of most spacecraft and are quite fragile. Inorganic paints can achieve high emissivity but weigh more than anodic coatings and Teflon is not resistant to the LEO environment. Anodic coatings of aluminum are one of the most attractive thermal coating systems because of the light weight of the anodic coating, it is integral with the aluminum substrate, it does not spall or chip even from micrometeoroid/debris impact, and is completely resistant to erosion from atomic oxygen. In addition relatively high emissivities can be obtained.

Anodizing is an electrolytic process that produces an oxide film on the surface of a metal. When aluminum is anodized in a sulfuric acid electrolyte, a porous film of aluminum oxide is formed on the surface of the part. Anodized 5657 aluminum represents a promising candidate for the thermal control coating of the radiators. It has a low $\alpha$ and a relatively high $\epsilon$; typically, $\alpha=0.2$ and $\epsilon=0.85$ for a 0.001 inch thick coating. However, a higher emissivity is more desirable for spacecraft thermal surfaces such as the radiators. A more efficient radiator results in less radiator surface required for the task, hence less weight. For example, an increase of 1% in the emissivity can reduce the size of a radiator panel by 1%. Additional drawbacks associated with anodic coatings is the higher solar absorptance $\alpha$ with some aluminum alloys than desired and the increase in solar absorptance that occurs with LEO space exposure.

Representative of the prior art is Gilliland et al U.S. Pat. No. 4,397,716 which discloses anodizing aluminum surfaces in chromic acid as the anodizing electrolyte to obtain an anodized coating adapted to be exposed to solar radiation and having a thermal emittance in the range of 0.10 to 0.72 and a solar absorptance in the range of 0.2 to 0.4. However a higher thermal emittance is required for more efficient spacecraft thermal surfaces, as noted above. Further, chromic acid anodizing produces thin rather amorphous oxide coatings whereas sulfuric acid anodized coatings are much thicker and exhibit a columnar crystalline structure. In addition, chromic acid anodizing produces a matte surface finish with low infrared emittance, as well as high solar absorptance, whereas sulfuric acid anodizing yields a transparent and semispecular coating with a higher infrared emittance and a lower solar absorptance.

Accordingly, one object of the invention is the provision of procedure for producing a high emittance coating on aluminum or its alloys.

Another object is to provide novel anodizing procedure for aluminum or its alloys, so as to result in an anodized coating having high infrared emissivity, and also low solar absorptivity.

A still further object is the provision of a high emittance anodized coating on aluminum or an alloy thereof.

Further objects and advantages will appear hereinafter.

SUMMARY OF THE INVENTION

The above objects and advantages are achieved according to the invention to obtain anodic coatings having higher emissivity by the implementation of a step-wise current density procedure during anodizing using a sulfuric acid electrolyte at a temperature higher than normal during anodizing.

Briefly then the present invention provides a process for anodizing aluminum or its alloys to obtain a surface having a high infrared emittance and a low solar absorptance which comprises anodizing an aluminum or an aluminum alloy surface in an aqueous sulfuric acid solution at elevated temperature and by a step-wise current density procedure, followed by sealing the resulting anodized surface.

The high emittance anodic coating of the invention can save an approximate 7% in weight of the radiators compared with a standard anodic coating. It is also easily and economically applied and retains all of the desirable properties of standard anodic coatings such as LEO survival, wear, handling and corrosion resistance. The modifications of the new anodizing procedure can be readily implemented in production lines.

DETAILED DESCRIPTION OF THE INVENTION AND PREFERRED EMBODIMENTS

As previously noted, the present invention is directed to a method of anodizing aluminum or its alloys wherein the anodized surface has low solar absorptivity and high infrared emissivity by use of a step-wise current density and a high bath temperature in the sulfuric acid electrolyte.

Aluminum or any of its alloys can be anodized according to the invention. These include, for example, the 5,000 series of aluminum alloys containing Mg as a primary alloying element, the 7,000 series containing Zn as primary alloying element, the 2,000 series containing Cu as a primary element and the 6,000 series containing Si and Mg as primary alloying elements. Anodized 5657 aluminum provides a preferred anodized thermal coating for the radiators on spacecraft, and hence 5657 aluminum is the preferred material anodized according to the invention.

The concentration of the sulfuric acid anodizing electrolyte can range broadly from about 5 to about 25% by weight. Concentrations of sulfuric acid greater than 25% by weight result in an anodic coating giving good optical properties but inferior in terms of ultraviolet radiation stability. Concentrations of sulfuric acid below about 5% by weight are no longer sufficiently conductive and thermally induced electrochemical attack of the sample occurs. A particularly effective and preferred sulfuric acid concentration is 15% by weight.

During anodizing, the bath temperature of the sulfuric acid electrolyte is maintained at about 30° C. This is considered a high bath temperature for sulfuric acid anodizing, since conventional anodizing in sulfuric acid is usually carried out at room temperature or lower.

As a feature of the invention anodizing takes place using a direct current step-wise current density procedure at a current density ranging from about 10 to about 20 amperes per square ft. (ASF). The step-wise current density procedure according to the invention proceeds in a manner wherein the first step of the current density procedure is at a higher current density in the current density range, and the last step is at a lower current density in such range. It has been found particularly effective to carry out the anodizing procedure in three steps, namely at 19 ASF, 15 ASF and 10 ASF. At direct current densities above 19 ASF, the samples become too hot and commence to burn. Below about 10 ASF, the required coating thickness is not achieved. Thus the process is quite sensitive to current density.

It has been found that best results are achieved wherein each of the current density steps of the step-wise current density procedure is maintained constant at that current density for a period of about 20 minutes. Thus, a preferred step-wise procedure is to maintain current density at about 19 ASF for about 20 minutes, at about 15 ASF for about 20 minutes, and about 10 ASF for about 20 minutes. The duration of each of the steps can be about 20 minutes ± 2 minutes, in preferred practice. If desired, the step-wise current density procedure can proceed from a lower current density to a higher current density in the above range, namely in 10 ASF, 15 ASF and 19 ASF steps, and still obtain an anodized coating having high emittance. However, this results in an undesirably soft anodic coating. Thus it is preferred to start at the higher current density and proceed to a lower current density in the step-wise current density procedure.

For carrying out the above step-wise current density procedure, a 40 volts power source can be employed.

For the anodizing procedure, lead or aluminum is normally employed as the cathode. Either a lead tank or a piece of lead can be employed as the cathode. The sample or aluminum substrate to be anodized is made the anode.

Prior to anodizing, sample preparation of the aluminum or aluminum alloy substrate is carried out. In the initial preparation step, the aluminum or aluminum alloy sample is subjected to alkaline cleaning as by treatment in a suitable non-etching aluminum alkaline cleaner at elevated temperature, followed by rinsing with water. The resulting substrate surface is then subjected to chemical brightening by use of a generally acid solution. In preferred practice, the substrate surface is brightened by immersion in a solution of a mixture of phosphoric acid and nitric acids, resulting in a shiny surface. The so-treated substrate is then rinsed with water.

Following anodizing, according to the above noted step-wise current density procedure, the anodic coating is sealed by immersion in a demineralized water bath at elevated temperature, e.g. about 200° F. (93° C.) for a short period, followed by air drying.

The anodized aluminum surface produced according to the invention has a high infrared emittance ranging from about 0.82 to about 0.92, generally about 0.90, and a solar absorptance ranging from 0.2 to about 0.3. The thickness of the anodic coating ranges from about 0.8 mil to about 1.2 mils, generally about 1 mil. It should be noted in this respect that a substantially thicker anodic coating is obtained according to the invention procedure as contrasted to the anodic coating obtained by chromic acid anodizing, as in the above patent.

The anodic coating of the invention is useful for all spacecraft thermal controlled surfaces where low solar absorptivity and high infrared emissivity are required. The anodic coatings of the invention can also be used in the terrestrial environment, including indoor or outdoor architectural or domestic applications.

The following are examples of practice of the invention:

EXAMPLE 1

Sample Preparation

A sample of 5657 aluminum alloy was alkaline cleaned by immersion in a solution of Turco 4090, a soap-like proprietary cleaner marketed by Turco Products, INc. of Westminster, California, for 15 min at 200° F. and rinsed with tap water. Then, it was chemically brightened by immersion in a solution of 85 parts of reagent grade phosphoric acid and 15 parts of reagent grade nitric acid, by weight, at 200° F. for 45 seconds. The sample was then rinsed with tap water.

Anodizing

After bright dipping, the aluminum alloy sample was anodized in a 15% by weight of reagent grade sulfuric acid anodizing electrolyte in a temperature controlled lead tank. The anodizing bath temperature is 30° C. The power was supplied by a 40-volts, direct current 10 amperes power source using the lead tank as the cathode and the sample part as the anode. The step-wise current density procedure was carried out at 19 amperes per square ft. (ASF) for 20 minutes, 15 ASF for 20 minutes, and 10 ASF for 20 minutes. After anodizing, the sample was sealed by immersion in a demineralized water bath at 200° F. for 5 minutes. The sample was then air dried.

The anodic coating produced had a high infrared emissivity of 0.92 and a low solar absorptivity of 0.2. The thickness of the anodic coating was 1 mil.

EXAMPLE 2

The procedure of Example 1 is essentially followed except that the concentration of the sulfuric acid anodizing electrolyte is 10% by weight and the duration of each of the three steps of the step-wise current density procedure is 22 minutes.

Results similar to Example 1 are obtained.

EXAMPLE 3

The procedure of Example 1 is essentially followed except that the sulfuric anodizing electrolyte is 20% by weight sulfuric acid and the time duration of each step of the step-wise current density procedure is 18 minutes.

Results similar to Example 1 are obtained.

EXAMPLE 4

This example summarizes and compares the optical properties of the anodic coating produced by subjecting a number of aluminum alloys to anodizing using a standard sulfuric acid anodizing procedure, followed by a hot water seal, with the optical properties of the anodic coating obtained by subjecting the same aluminum alloys to the sulfuric acid step-wise invention anodizing procedure of Example 1, followed by a hot water seal.

The standard sulfuric acid procedure was carried out by first subjecting the respective aluminum alloys to alkaline cleaning, followed by treatment in a tri-acid etch formed of a solution of a mixture of nitric, hydrofluoric and chromic acids, The cleaned surface was then anodized in a sulfuric acid electrolyte using 18% by weight sulfuric acid at room temperature. The voltage applied was 15 volts and the current density approximately 12 to 13 ASF. Anodizing was carried out for a period of 45 minutes, followed by sealing the anodized surface in hot demineralized water for 5 minutes at 200° F., followed by air drying.

The optical properties of the anodic coatings produced according to the standard sulfuric acid process above as compared to the anodic coatings produced by the high emittance anodizing process of Example 1 are set forth in the table below.

TABLE

| Aluminum Alloy Material | Type of Sulfuric Acid Anodize | Solar Absorptance $\alpha$ | Infrared Emmittance $\epsilon$ |
|---|---|---|---|
| 2024-T6 | Standard | 0.35 | 0.79 |
| | High Emittance | 0.32 | 0.83 |
| 5056-H25 | Standard | 0.17 | 0.82 |
| | High Emittance | 0.22 | 0.91 |
| 6061-T6 | Standard | 0.39 | 0.82 |
| | High Emittance | 0.30 | 0.90 |
| 6063-T52 | Standard | 0.24 | 0.78 |
| | High Emittance | 0.20 | 0.90 |
| 7075-T6 | Standard | 0.35 | 0.79 |
| | High Emittance | 0.27 | 0.82 |
| Alclad | Standard | 0.21 | 0.78 |
| 7075-T6 | High Emittance | 0.18 | 0.90 |

The solar absorptance and infrared emittance values using the standard sulfuric acid anodizing process represent the average value of three samples. The solar absorptance and infrared emittance values for the high emittance sulfuric acid step-wise anodizing procedure of the invention carried out according to Example 1 are for a single sample prepared by such method.

From the above table, it is seen that the infrared emittance values of the anodic coating produced by the high emittance invention procedure for the various aluminum alloys tested are mainly of the order of about 0.90, as compared to mainly about 0.8 for the anodic coating produced by the standard sulfuric acid procedure. Further, many of the values of solar absorptance for the anodic coatings produced by the standard process are relatively high, e.g. 0.35 and 0.39, as compared to the solar absorptance of the anodic coatings produced by the invention high emittance procedure of Example 1, which are generally substantially below 0.32, including values of 0.18, 0.20 and 0.22.

From the foregoing, it is seen that the invention provides a novel anodizing procedure for producing anodic coatings particularly having high emittance, employing a step-wise current density procedure combined with use of a higher sulfuric acid bath temperature than employed in the conventional sulfuric anodizing process. The main feature is the achievement of anodic coatings with higher emissivity values up to about 0.92, than have previously been obtained for anodic coatings.

Since various changes and modifications of the invention will occur to those skilled in the art within the spirit of the invention, the invention is not to be taken as limited except by the scope of the appended claims.

What is claimed is:

1. A process for anodizing aluminum or its alloys to obtain a surface having a high infrared emittance and a low solar absorptance which comprises anodizing an aluminum or aluminum alloy surface in an aqueous sulfuric acid solution at elevated temperature and by a step-wise current density procedure, and sealing the resulting anodized surface.

2. The process of claim 1, the sulfuric acid concentration ranging from about 5 to about 25% by weight and maintained at a temperature of about 30° C.

3. The process of claim 2, said step-wise current density procedure being in the range from about 10 to about 20 amperes per square ft.

4. The process of claim 3, wherein the first step of the current density procedure is at a higher current density in said range and the last step is at a lower current density in said range.

5. The process of claim 4, wherein said step-wise current density procedure is carried out in three steps (1) at 19 amperes per square ft. (ASF), (2) at 15 ASF and (3) at 10 ASF.

6. The process of claim 5, wherein each of said steps of said step-wise current density procedure is for a period of about 20 minutes.

7. The process of claim 1, including the initial steps of cleaning said aluminum or aluminum alloy surface in an alkaline cleaner and brightening the resulting cleaned surface in an acid solution.

8. The process of claim 7, wherein said acid brightening solution comprises a mixture of phosphoric acid and nitric acids.

9. The process of claim 1, wherein said sealing of said anodized surface is carried out by immersion in a demineralized water bath at elevated temperature.

10. A process for anodizing aluminum or its alloys to obtain a surface having a high infrared emittance and a low solar absorptance which comprises treating a substrate in the form of an aluminum or an aluminum alloy surface in an alkaline cleaner, treating the resulting surface in a chemical brightener comprised of a mixture of phosphoric acid and nitric acids, anodizing the resulting brightened surface in approximately 15% by weight of sulfuric acid at about 30° C. by a direct current step-wise current density procedure at about 19 ASF for about 20 minutes, at about 15 ASF for about 20 minutes, and at about 10 ASF for about 20 minutes, and treating the resulting anodized surface in a demineralized water bath at elevated temperature, to seal the anodized surface.

11. The process of claim 10, using a 40 volt, power supply during said anodizing.

12. The process of claim 10, the sealing of said anodized surface being carried out in said demineralized water bath at about 200° F., and including air drying the sealed anodized surface.

13. The process of claim 2, said anodized surface having an infrared emittance ranging from about 0.82 to about 0.92, and a solar absorptance ranging from about 0.2 to about 0.3, the thickness of the anodic coating ranging from about 0.8 mil to about 1.2 mils.

14. The process of claim 10, wherein said substrate is 5657 aluminum.

15. The process of claim 14, said anodized surface having an infrared emittance of about 0.92 and a solar absorptance of about 0.2, the thickness of the anodic coating being about 1 mil.

16. A high emittance anodic coating on aluminum or an aluminum alloy, produced by the process of claim 1.

17. A high emittance anodic coating on aluminum or an aluminum alloy, produced by the process of claim 10.

* * * * *